United States Patent [19]

Gogniat

[11] Patent Number: 4,740,935

[45] Date of Patent: Apr. 26, 1988

[54] WATCHCASE HAVING MECHANISM FOR SECURING CRYSTAL TO CASE

[75] Inventor: Paul Gogniat, Berne, Switzerland

[73] Assignee: Montres Rado S.A., Biel, Switzerland

[21] Appl. No.: 49,312

[22] Filed: May 13, 1987

Related U.S. Application Data

[60] Division of Ser. No. 807,215, Dec. 12, 1985, which is a continuation of Ser. No. 121,528, Feb. 14, 1980, abandoned.

[30] Foreign Application Priority Data

Feb. 12, 1979 [CH] Switzerland ..... 1717/79
Dec. 17, 1979 [CH] Switzerland ..... 11157/79

[51] Int. Cl.[4] ..... G04B 37/00

[52] U.S. Cl. ..... 368/294; 368/297; 368/295

[58] Field of Search ..... 368/292, 294–296, 368/280–284

[56] References Cited

U.S. PATENT DOCUMENTS

| | | | |
|---|---|---|---|
| 732,245 | 6/1903 | Weiss | 63/29 R |
| 1,735,384 | 10/1929 | Fielding | 63/4 |
| 2,029,769 | 2/1936 | Goldblatt | 368/294 |
| 2,659,105 | 11/1953 | Halbig et al. | 368/296 |
| 3,242,664 | 3/1966 | Lederrey | 368/282 |
| 3,292,362 | 12/1966 | Klingenberg | 368/295 |
| 3,643,423 | 2/1972 | Piquerez | 58/88 R |
| 3,837,163 | 9/1974 | Fujimori | 59/80 |
| 4,034,552 | 7/1977 | Davidson | 58/88 R |
| 4,198,811 | 4/1980 | Ratajski | 368/292 |
| 4,440,505 | 4/1984 | Gogniat | 368/292 |

FOREIGN PATENT DOCUMENTS

| | | |
|---|---|---|
| 332892 | 11/1958 | Switzerland . |
| 558040 | 1/1971 | Switzerland . |

OTHER PUBLICATIONS

Kronos Catalogue, vol. 1, No. 1, pp. 10, 18, 19, 21, 22 & last page; 1980/81 Tourneau, Inc.

Laid Open Utility Model Publ. No. 11768/1974, K. Takagi.

Laid Open Utility Model Publ. No. 54474/1974, M. Oka.

Japanese Abstract No. 53-70860.

Laid Open Patent Publ. No. 89769/1976, K. Imafuke et al.

*Primary Examiner*—Bernard Roskoski

*Attorney, Agent, or Firm*—Parkhurst & Oliff

[57] ABSTRACT

The piece of jewelry protected by a hard metal shielding may consist of a metallic watchband composed of elements jointed to each other. In this case each one of said elements comprises a body member 61 of a material suitable for machining, such as stainless steel, and a plate 64 of sintered hard metal which is secured to body member 61 by means of plugs 65 welded against the back side of plate 64 and riveted to body member 61. The upper surface of the watchband elements is thus protected against injuries which contacts with foreign bodies could produce. Since that face of the watchband elements is practically the only one which is visible, when the watch is carried, the watchband will keep its original appearance during all the time it will be carried.

5 Claims, 4 Drawing Sheets

FIG. 2
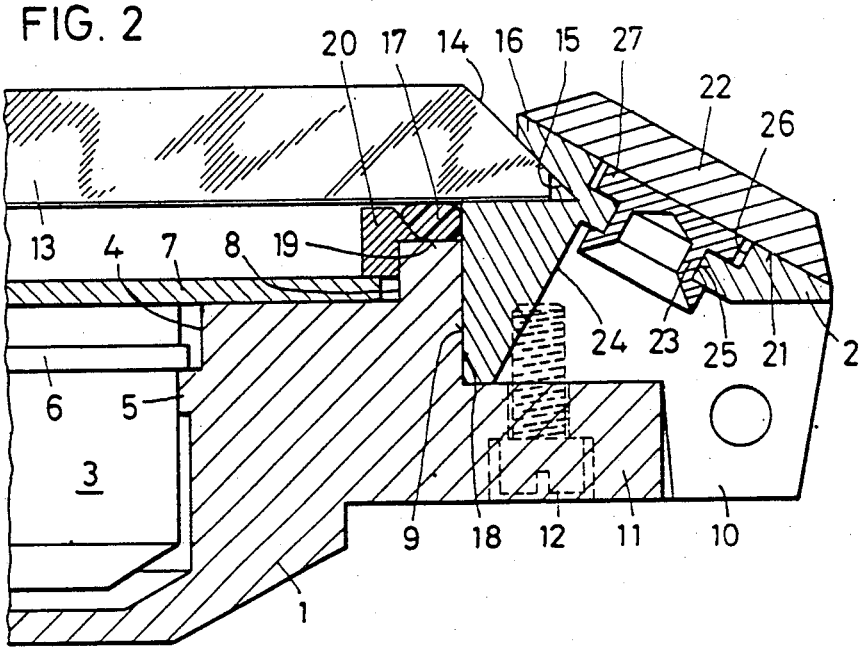
FIG. 3
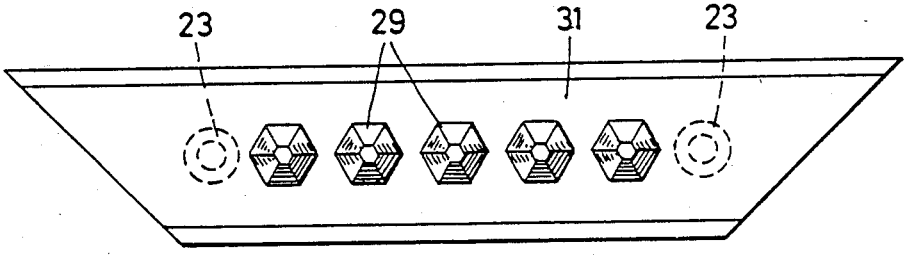
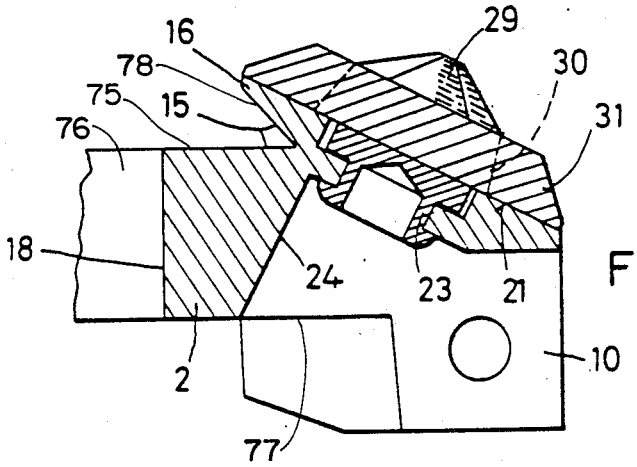
FIG. 4

FIG. 5
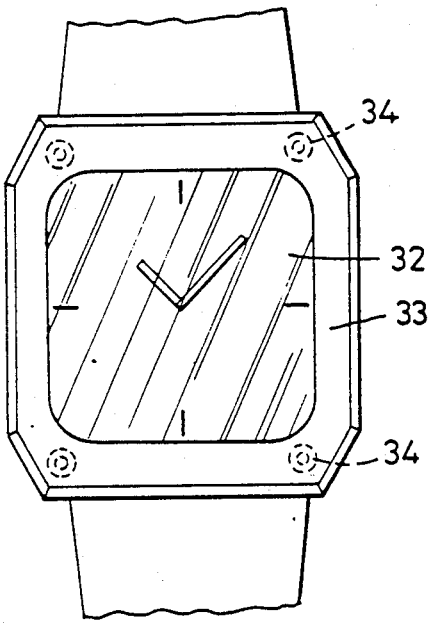
FIG. 6
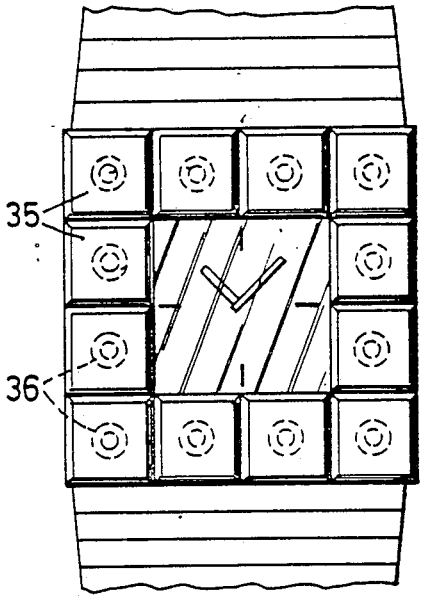
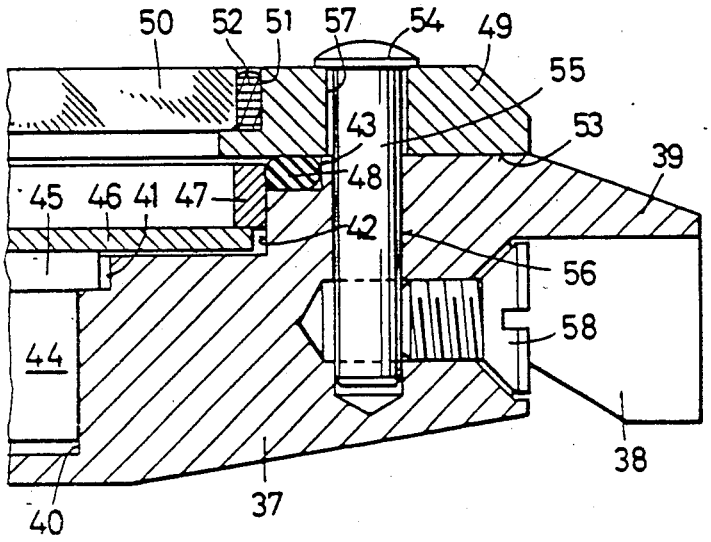
FIG. 7

WATCHCASE HAVING MECHANISM FOR SECURING CRYSTAL TO CASE

This is a division of application Ser. No. 807,215, filed Dec. 12, 1985, pending, which in turn is A continuation application of Ser. No. 121,528 filed Feb. 14, 1980, now abandoned.

BACKGROUND OF THE INVENTION

This invention relates to pieces of jewelry such as for instance watchcases, watchbands, bracelets, rings, cuff links, brooches, pendants and the like, which are protected by a sintered hard metal shielding, and more particularly to the means for anchoring thin shielding plates of sintered hard metal to a body member made out of a material suitable for machining.

With the pieces of jewelry of this type, which are known in the art, securing the protecting pieces to the body member of the piece of jewelry is achieved by welding as shown in U.S. Pat. No. 3,242,664.

This securing method is, however, not easy. By welding a sintered hard metal thin plate to a steel body member, for instance, the hard metal plate undergoes strong stresses, due to the different coefficients of thermal expansion of the materials involved. Moreover, at the welding temperatures, ranging about 1000° C., it is not possible to give the protecting piece its final appearance before welding. That piece has thus to be finished after welding. It should, however, be noted that these finishing operations, which include polishing, are the most arduous and also the most delicate, so that they cause the most numerous waste, thereby involving not only the loss of the hard metal piece, but also that of the whole body member already secured thereto. The long sequence of manufacturing operations with that known method has also great delays in delivery as a consequence. Finally, if polishing has to be followed by coloring the hard metal piece, the parts of the piece of jewelry, which shall not be colored, have to be masked and then, after coloring, to be uncovered again thus complicating the finishing operations even more while slackening their progress and increasing the risk of waste.

In practice, one resorted to bulky protecting pieces rather than to thin plates for shielding the pieces of jewelry. Moreover, in order to enable entire finishing of body members of material suitable for machining and the sintered hard metal protecting pieces every one for itself, gluing these two pieces to one another has been contemplated.

Unfortunately, gluing is not absolutely reliable. Under certain climates, glues undergo a breakup.

For ensuring the required anchoring, mechanical fixing means have also been proposed, even those comprising "latches" made out of rubber-like material as shown in U.S. Pat. No. 3,643,423.

However, that method of securing the two pieces in question to each other requires precise shapes and sizes of both the body member made out of a material suitable for machining and the sintered hard metal protecting piece, thus rendering the manufacture, in particular of the protecting piece, cumbersome, because of the relatively important shrinkage which the latter undergoes during sintering and because it must be given an appropriate shape before sintering, if one wishes, thereafter, to avoid expensive machining operations.

Long before using sintered hard metal with pieces of jewelry, those skilled in the art have had the idea of making a body member out of a material which can easily be machined and of protecting that body member by means of a shielding made out of a harder material as shown in Swiss Pat. Nos. 181,293 and 236,616. However, that known shielding consisted in a sheet of a material which was still malleable, such as stainless steel, and which can, accordingly, be shaped at will without difficulty, either by folding or swaging, in order to cover the softer body member of the piece to be protected and to be secured thereto merely by wrapping the body member or in any other mechanical manner, for instance by crimping, pinching and the like.

The means which were used for securing such a shielding to the body member which was to be protected can, however, not be utilized with a sintered hard metal shielding.

For securing a thin plate onto the body member of a piece of jewelery, mechanical anchoring means operating without an intermediate latch are also known in the art as shown in French Pat. No. 2,264,501.

In order safely to retain the dovetailed tenon in the corresponding slide, those known anchoring means, however, require an elastic deformation of the plate, which cannot be expected from a sintered hard metal plate.

SUMMARY OF THE INVENTION

To avoid making the piece of jewelry entirely out of sintered hard metal and also setting such a hard piece in contact with the skin, as proposed in U.S. Pat. No. 3,837,163, and in an attempt of limiting the sintered hard metal to the purpose of protecting the exposed surfaces of the piece of jewelry, the invention aims to provide anchoring means for securing the sintered hard metal thin protecting piece to the body member of a piece of jewelry while avoiding the difficulties, risks and drawbacks outlined hereabove.

In order to be efficient, the anchoring means, which are to be provided, shall, of course, enable, on the one hand, securing a thin piece of sintered hard metal, such as a plate, onto a body member of a material suitable for machining, and, on the other hand, to carry out that assemblage as a last operation, i.e. when both the protecting piece and the body member of the piece of jewelry have each been completely finished. A hard metal piece having a substantially constant thickness at every point is obviously much easier to be sintered than a piece having different thicknesses from point to point. Moreover, by mounting the protecting piece on the body member of the piece of jewelry in the last step of the manufacture, these two pieces can be made separately, but at the same time thereby permitting a substantial reduction of the terms of delivery. Finally, if some deficiency of the hard metal piece appears in the course of the finishing operations thereof, which would render that piece improper for sale, then its loss does not involve that of the body member, thus limiting the wastes to a minimum.

With the tool manufacture, securing a thin plate of sintered hard metal to a body member, for instance as steel, is of common practice. That assemblage is carried out by welding one side face of the hard metal plate to the body member. However, a plate having relatively large size, at least in one direction, is not welded directly on steel. As already mentioned hereabove, welding occurs at about 1000° C. and the hard metal plate would be disposed to break, becaue of the stresses appearing therein upon cooling, due to the difference between the coefficients of thermal expansion of steel and sintered hard metal. Therefore, the hard metal plates of tools are welded to the steel body members thereof while inserting a plate of a very malleable material such as copper therebetween.

For the sake of the appearance and also because of the risk of corrosion, the method commonly used with tools for securing a thin plate of sintered hard metal onto a body member being usually of steel, cannot be applied to pieces of jewelry. Furthermore, when the piece of jewelry consists of the casing of a wristwatch whose bezel, i.e. the part surrounding the glass, is mostly exposed to injury, it can be advantageous to form the hard metal protecting piece as a bezel and to secure the glass thereto, even to use that piece as a closing member of the watchcase. In the last event, the hard metal protecting piece has to be secured to the body member of the casing in a removable and not in a permanent manner.

With the structure disclosed and claimed herein, these objective can be achieved.

According thereto, the shape of the piece of jewerly is obtained by conventional machining operations which are carried out on the material suitable for machining of the body member of that piece. The piece or pieces of hard metal which are then secured thereto and which have an almost constant thickness, do not alter the shape of the body member; they merely increase its volume to a slight extent. The body member and its shielding each can be entirely separately manufactured, and these two pieces can then be secured to one another in a last step, just before delivery. Since the securing plugs of the protecting piece only occupy a very small part of the side face thereof, it is not difficult to find a suitable location for these plugs.

The plugs can advantageously be welded without any risk against the side face of the protecting piece set on the body member. Since welding only occurs in a very small area of the hard metal protecting piece, the risk of breaking due to the stresses arising upon cooling is, indeed, totally avoided. Moreover, the plugs which are welded to the hard metal piece in the course of its manufacture, do not at all impede the finishing operations of that piece, because they are on a face thereof which is not visible and therefore need not be treated when finishing that piece.

Instead of fixing the securing plugs to the protecting piece like feet, it can, in some instances, also be advantageous to use said plugs with an ornamental head piece. If judiciously polished, the head of the securing plugs can even appear as a precious stone set in the hard metal protecting piece.

Fastening in turn the securing plugs in the body member of the piece of jewellery can be achieved in different ways. It can be removable or permanent, mechanical or otherwise secured, for example by gluing or welding. If there is no need to remove the protecting piece from the body member of the piece of jewelry the securing plugs can simply be retained in that body member.

In another a structure the removableness of the protecting piece is essential. In such an instance, the securing plugs can advantageously be retained in the body member of the piece of jewelry. The latching members may be used which have, indeed, the advantage that they are completely hidden, but nevertheless easily accessible.

Whereas it was not possible heretofore to set precious or semi-precious stones in sintered hard metal the invention provides a structure, with which a sintered hard metal piece precisely holds such ornamental elements in place.

The pieces of jewelery which it is particularly advisable to protect by means of a sintered hard metal shielding, are chiefly watchcases, more particularly casings of wristwatches, watchbands, bracelets, rings, cuff links, brooches, pendants and the like.

With wristwatch casings it is essentially the upper face of the bezel which is exposed to injuries by coming in contact with foreign bodies. Moreover, the appearance of the watch chiefly depends on that of said upper bezel face. It is therefore sufficient to protect that face. When the casing comprises a bezel which completely surrounds the glass, the protecting piece may constitute the closing member of the watchcase, while avoiding any joint on the bottom side, the bottom and the case band being made in one piece.

Additionally, there may be used a shielding structure which is particularly efficient with metallic watchbands composed of elements jointed to each other.

When two plugs are necessary for securing a protecting piece, they can advantageously be provided, although welding extends in this case over a substantially larger part of the back side of the protecting piece than in the previous cases, the difference of the coefficients of thermal expansion of the protecting piece and of the piece carrying the securing plugs does not produce dangerous stresses in the protecting piece, because of the stretchability of the other piece.

BRIEF DESCRIPTION OF THE INVENTION

Eight embodiments of the piece of jewery according to the invention are represented diagrammatically and by way of example in the accompanying drawings in which:

FIG. 2 is a cross-sectional view, along line II—II of FIG. 1,

FIG. 3 is a plan view of a part of the second embodiment,

Figure 8:
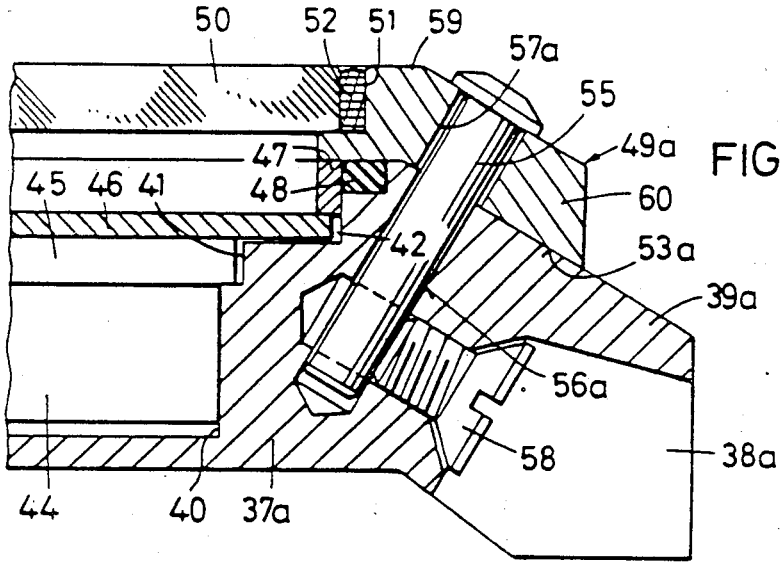
Figure 9:
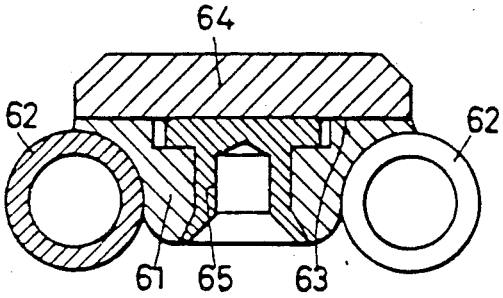
Figure 11:
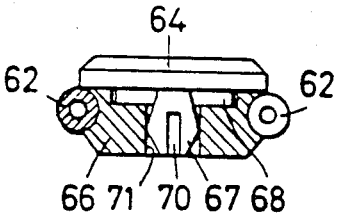
Figure 10:
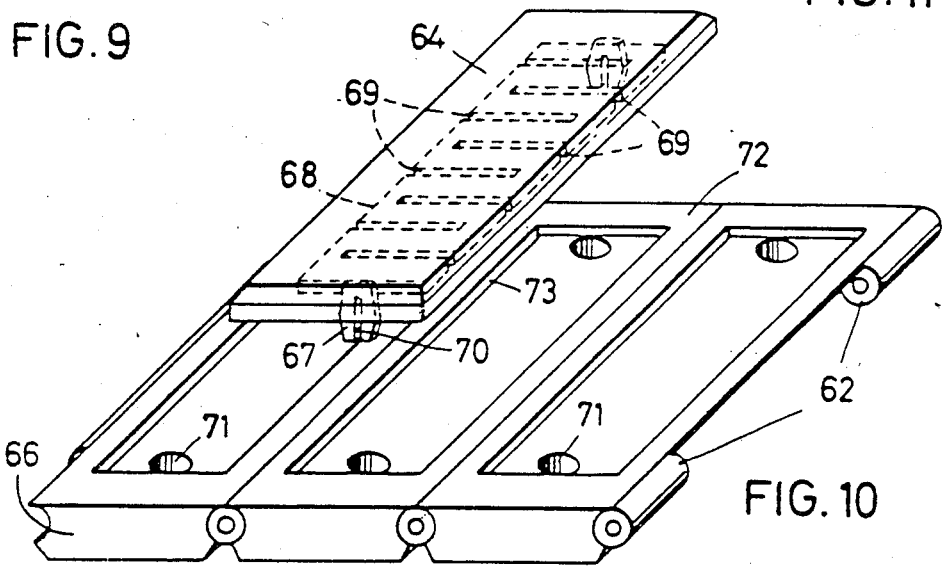

FIG. 4 is a partial cross-sectional view of this second embodiment, similar to that of FIG. 2, FIG. 5 is a plan view on a reduced scale of the third embodiment, FIG. 6 is a plan view similar to FIG. 5, showing the fourth embodiment, FIGS. 7 and 8 are sectional views similar to FIG. 2, but showing the fifth and the sixth embodiments, respectively, FIG. 9 is a cross-section of one element of the seventh embodiment, FIG. 10 is an exploded perspective view of a part of the eighth embodiment, and FIG. 11 is a cross-section of one element of this eighth embodiment.

DESCRIPTION OF THE PREFERRED EMBODIMENTS

Figure 1:
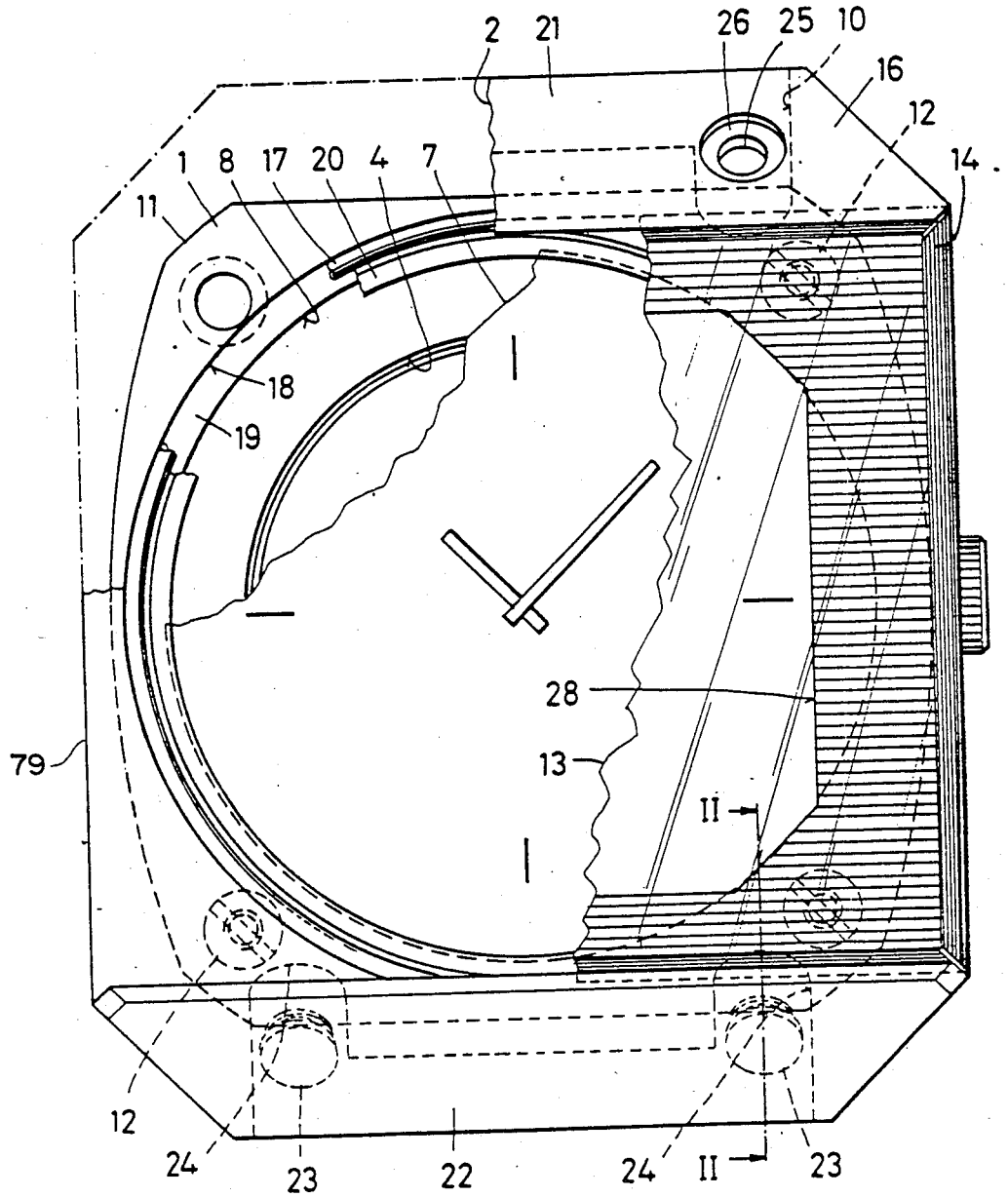
FIG. 1 is a plan view with some parts broken away of the first embodiment.

The first embodiment of the piece of jewelry according to the invention (FIGS. 1 and 2) consists of a wristwatch casing. This casing comprises a cup-shaped bottom section 1 and a combined bezel and case band section 2, (i.e., body member) both being made of stainless steel. The body member 2 includes an upper face 75, a lower face 77 and a central opening 76 located between the upper face 75 and the lower face 77, said central opening 76 being defined by an annular inner flank 18. The body member 2 further includes an outer flank 79. The watch movement 3 is inserted from the top into section 1 and located in a cylindrical lodging 4 thereof. It is held at the right place therein by a rim 5 of section 1, on which rim 6 of the base plate of the watch movement lies. The dial 7 extends radially outwards, beyond the watch movement periphery into a circular recess 8 of section 1. Section 2 of the watchcase is set around a cylindrical or annular bearing surface 9 of section 1. It carries lugs 10 for attachment to a watchband. Section 2 lies on a flange 11 of section 1 and it is secured to the latter by means of four screws 12.

The casing described is tightly closed by a flat sapphire glass 13 (or crystal) having bevelled edges 14. The glass 13 is rectangular and located in a slideway 15 formed in upward projections 16 of section 2 extending above the lugs 10, therebetween. Particularly, the upward projections 16 form at least two bearing surfaces 78 which cooperate with the upper face 75 to define two opposed parallely located slideways 15. The two other casing sides are covered by glass 13 which, at those places, extends outwards so as to be flush with the corresponding two side faces of the casing.

The tight closure of the described casing is ensured by an annular gasket 17 which is pressed by the glass 13 against the bottom of a groove formed by the inner cylindrical wall 18 of section 2, the upper face 19 of section 1 and a spacing ring 20. The compressed gasket 17 also prevents the glass 13 from incidentally sliding within the slideways 15. Therefore, the glass 13 must be inserted into the slideways 15 before screwing down the screws 12, when closing the watchcase. Some edges of the glass 13 engage the at least two bearing surfaces 78 and those edges which do not so engage the bearing surfaces 78 are flush with the outer flank 79.

It results from the foregoing disclosure and from the drawing that the upper faces 21 of projections 16, operating as bezel, are the sole casing parts which are really exposed to injuries, for instance by scratches, upon coming in contact with rigid foreign bodies when the watch is carried. Accordingly, to save the nice casing appearance, it suffices to protect faces 21.

In the first embodiment that protection is ensured by a sintered hard metal shielding consisting in two plates 22 set on faces 21. Since faces 21 are plain, the plates 22 are flat. They have a traperiodal contour and their two long side edges are bevelled. Moreover, the outer face of the plates 22*a*, as shown, for example, in FIG. 2, is substantially parallel to the face 21. The manufacture of plates 22 is very easy, because of their very simple shape. The thickness of plates 22 is constant and chosen so that these plates will be able to resist pressures, especially to impacts, incidentally produced in use by foreign rigid bodies.

The disclosed shielding appears extremely rational, because it is limited to what is really necessary in practice. However, it could not have been warranted without the solution disclosed hereinafter for securing the hard metal plates 22 to the steel body member of the casing, which, in this embodiment consists of section 2.

In order to secure on faces 21 the hard metal protecting pieces constituted by plates 22, two plugs 23 are welded against the back side of plates 22, which need not be involved in the finishing operations, because they are hidden. Welding of plugs 23 is carried out immediately after sintering plates 22, i.e. before submitting the latter to the finishing operations. The plugs 23 are made out of steel so that they can be made by lathe-turning. Although the surface of contact between plugs 23 and plates 22 is small, the welding disclosed ensures a quite satisfactory attachment of plugs 23.

After the welding disclosed, the visible faces of plates 22 are polished in the conventional manner well known to those skilled in the art. They can also be coated by a colored coating. If plates 22 are made of sintered tungsten carbide, the coloration can, for instance, be obtained by forming a nitride coating on the visible faces of plates 22.

Below each face 21 and between lugs 10, cutouts 24 are provided in section 2 and holes 25 are bored in face 21 so as to open in cutouts 24. A recess 26 is formed at the upper end of holes 25 for receiving the larger head portion 27 of plugs 23. In order to avoid any permanent stress in plates 22, the depth of recess 26 can be made a little smaller than the height of portion 27. In that way, it is the head portion 27 which will be pressed against the bottom of recess 26 and not plate 22 against face 21, when the plugs 23 will be entirely set into holes 25.

When the plates 22 have been set in place as disclosed, the ends of plugs 23 are protruding into cutouts 24 of section 2 thus enabling riveting plugs 23 and, accordingly, permanently securing plates 22 to section 2. This riveting does, of course, not produce any stress either in section 2 or in plates 22, which could anyhow injure these pieces. Accordingly, it can be carried out at the last moment, so that section 2 and plates 22 can quite separately be manufactured and entirely finished in the desired manner. There is thus no need to proceed with securing the hard metal plates to the steel body member of the casing before undertaking the finishing operations of the plates, thereby risking to lose the whole casing, if either one of the hard metal plates revealed itself improper for sale during polishing.

It clearly appears from the drawing that the shape of the watchcase is entirely determined by sections 1 and 2. Plates 22 merely increase somewhat the height of the casing parts serving as bezel. Since sections 1 and 2 are made of steel, their manufacture is easy and quite conventional. Sections 1 and 2 could, of course, also be made of another material suitable for machining, such as for instance brass, aluminum or even a synthetic material.

For hiding gasket 17 and spacing ring 20 a metallic coating 28 is deposited on the lower face of the glass 13, at the periphery thereof.

The second embodiment (FIGS. 3 and 4) only differs from the first one by the presence of precious or semi-precious gems 25 which are located in openings 30 of the hard metal plates 31. The side walls of openings 30 are slightly undercut in order to hold gems 29 by clamping between the edges of openings 30 and face 21 of projection 16.

The piece of jewelry according to the third embodiment (FIG. 5) also consists of a wristwatch casing. It comprises a bezel which completely surrounds the glass 32. In that case, the protecting hard metal piece is constituted by a thin frame 33 which wholly covers the bezel of the watchcase. Securing that frame to the body member of the casing made out of a material suitable for machining is ensured by means of four plugs 34 welded against its back face.

The fourth embodiment (FIG. 6) substantially differs from the third one by the fact that shielding is not ensured by a single piece, but by a plurality of square plates 35 which are arranged side by side and individually secured to the watchcase body member of a material suitable for machining, each one by means of a plug 36. Although plugs 36 are cylindrical, as in the preceding embodiments, plates 35 are nevertheless prevented from rotating around their plugs 36, because of their arrangement side by side.

If in other embodiments such a rotation were to be feared, upon fixing a hard metal protecting piece by means of a single plug, that risk could simply be avoided by using a prismatic plug and by inserting the same in a hole having a corresponding shape of the body member of a material suitable for machining.

The fifth embodiment (FIG. 7) is still constituted by a wristwatch casing. It comprises a steel body member 37 which constitutes both the bottom and the case band and which carries the lugs 38 for the attachment to a watchband as well as a thin web 39 extending between the lugs located on the same side of the casing. A plurality of recesses 40, 41, 42, 43 are provided in member 37 for accomodation of the watch movement 44, of a watch movement rim 45 ensuring the axial position of the movement within the casing, of the watch dial 46 and a spacing ring 47, and of a tightening O-ring 48, respectively, which encompasses the spacing ring 47 and is thus located in a peripheral groove of the casing.

Movement 44 and dial 46 are held in their recesses by a hard metal bezel 49 carrying a flat glass 50 made of a tempered silicate or of sapphire. The bezel 49 is also flat and only a little thicker than the glass 50 in order that a recess 51, serving as receptacle for the glass and having a depth at least equal to the glass thickness may be provided therein. The glass 50 can thus be entirely set within the bezel so that its upper corner does not risk becoming nicked or jagged upon shocks against foreign rigid bodies. According to the usual practice with hard glasses, as well known to those skilled in the art, a sleeve 52 made out of a material softer than the glass and the bezel is inserted between these two pieces. This sleeve forms a cushion compensating both the manufacturing tolerances of the glass 50 and of its receptacle 51 and the difference between the coefficients of thermal expansion of these two pieces, it also tightens the gap therebetween.

In order to close this casing, bezel 49 is applied on the upper plane face 53 of member 37 while pressing O-ring 48 in the groove formed by recess 43 and ring 47. The bezel is secured in that position by the heads 54 of four plugs each having a shaft 55 made integral with head 54 and inserted in a hole 56 of member 37 while passing through borings 57 of bezel 49. Locking screws 58, located between the lugs 38 under the webs 39, hold plugs 54, 55 axially in place in a removable manner.

Since the only stresses, which plugs 54, 55 have to support, result from the permanent tensile force produced by the compressed tightening O-ring 48 and from the incidental shearing which may result from transverse impacts, their shaft 55 may have a relatively small diameter, less than one millimeter, especially when the plugs are made of steel. the head 54, having a diameter only a little larger than shaft 55, only forms a small projection above the bezel. By judiciously shaping its polished surface, it is even possible to produce the impression that precious stones are set on the bezel 49. By giving the upper portion of bores 57 a conical shape, it is in turn possible to locate the plug head entirely within the bezel.

Since the flat bezel 49 has everywhere substantially the same thickness, its manufacture is easy whatever contour it may have. The risk of warping due to the strinkage in the course of sintering is also small. Since the bezel merely constitutes a thickness increase, but does not modify either the number of faces of the watchcase body member or their orientation, it is clear that the final shape of the watchcase entirely depends on that of member 37 which can easily be manufactured in the conventional manner, because it is a body member made of a material suitable for machining.

Since the disclosed bezel, to its whole extent, lies on member 37, it will safely resist the strains imparted thereto upon incidentally striking against foreign bodies, as may occur in use. Since it is chiefly the upper surface of the watchcase, which is exposed to such incidental contacts when the watch is normally carried on the arm and since it is principally that surface which is then visible, the hard metal bezel 49, covering the whole upper surface of the casing, constitutes an adequate shielding of the watchcase warranting the perenniality of its initial aspect. As regards the two diametrically opposed webs 39 extending between the two watchband attaching lugs on the same side of the casing and which remain uncovered, they do not form part of the very envelope of the watch movement; they rather appear as part of the watchband, espacially when the latter is made of steel.

The sixth embodiment (FIG. 8) differs from the fifth one only by the shape of the upper surface of the casing. Instead of a plane upper face, the member **37*a* has an inclined upper face 53*a*. The bezel 49*a* comprises in this case an inner section 59 having flat side faces and carries the glass 50 fully embedded in recess 51. The bezel also comprises an outer section 60 with inclined side faces. The bores 57*a* provided across section 60 of bezel 49*a* are perpendicular to the side faces of this bezel section, so that the plug shafts 55 are obliquely inserted into the casing. The locking screws 58 of the bezel securing plugs remain perpendicular to the shafts 55** thereof.

In this embodiment too, the bezel has an approximately constant thickness and in closed position it lies on member **37*a* while covering the whole upper face thereof with the exception of webs 39*a* extending between the two lugs on either side of the wathcase. The part of bezel 49*a* is accordingly exactly the same as that of bezel 49** in the fifth embodiment.

The piece of jewelry according to the seventh embodiment (FIG. 9) consists of a metallic watchband comprising a row of elements joined to each other, FIG. 9 is a cross-section of such an element which comprises a body member 61 of stainless steel, but which could just as well be made of another material suitable for machining. Hinges 62 for joining the element represented to the neighboring elements are rigidly fixed to body member 61. They could, however, also be made in one piece therewith.

When the band is carried, it is the upper surface 63 of that element which is exposed to the risk of coming incidentally in contact with foreign rigid bodies. Since that upper surface is substantially the sole visible face of the element represented, it suffices to protect that surface by means of a hard metal shielding. Due to the fact that the surface in question is plane, its protection can be achieved by means of a rectangular hard metal plate 64. Securing that plate 64 to the body member 61 occurs by means of pair of plugs 65 welded against its back side and riveted to body member 61 as disclosed in detail in the case of plates 22 in the first embodiment.

The last embodiment represented in the drawing (FIGS. 10 and 11) essentially only differs from the preceding one by the means ensuring the fixation of the protecting plates 64 to the body members 66 of the watchband elements. In this embodiment the two fixing plugs 67 of a plate 64 are made integral with an elongated rectangular piece 68 of steel, which is welded against the back side of plate 64. Transverse slots 69 alternately extending inwards from the two side edges of piece 68 render this piece easily stretchable in the direction of its longitudinal axis, so that it will not produce a dangerous stress of plate 64 upon cooling after welding. The fixing plugs 67 are formed at the ends of piece 68 by bending the end portions of piece 68 at a right angle. The plugs obtained thereby are thus flat. They are made resilient by means of a longitudinal slot 70 provided in said plugs from their ends. The two legs formed by that slot move against each other when the corresponding plug is introduced into its hole 71 of body member 66 of the watchband element. Securing plugs 67 to the body members 66 is thus ensured by resilient clamping. Accordingly, that fixation is removable. In order that the hard metal plates 64 lie on the upper faces 72 of body members 66 of the watchband elements, recesses 73 are provided in these upper faces 72 for receiving pieces 68.

Instead of being flat or composed of flat facets, as shown in the eight embodiments disclosed hereabove, the protecting pieces could also be curved, provided that their thickness is substantially constant and relatively small, so that their shapes are as bidimensional in contradistinction to the three-dimensional shapes encountered heretofore in practice.

I claim:

1. A watch casing comprising:

a body member, said body member comprising an upper face, a lower face, an annular linear flank defining a central opening between said upper face and said lower face and upward projections comprising at least two first bearing surfaces facing said upper face of said body member, said at least two first bearing surfaces cooperating with said upper face to define two opposed parallelly located slideways;

a bottom member for closing the central opening at said lower face of said body member, said bottom member defining an annular second bearing surface contiguous to said annular inner flank of said body member;

securing means for fixing said bottom member to said body member;

a crystal for closing the central opening at said upper face of said body member, said crystal comprising at least two parallel opposed edges which slidably engage said parallely located slideways before assembly of said bottom member to said body member; and an annular gasket for rigidly securing said crystal to said body member, said annular gasket being compressed between said crystal and said second bearing surface, wherein said parallel opposed edges of said crystal elastically abut against and contact said at least two first bearing surfaces of said upward projections.

2. A watch casing according to claim 1, wherein said parallel opposed edges of said crystal are bevelled and said at least two first bearing surfaces are inclined with respect to said upper face of said body member, thereby defining slideways having a triangular cross-section which engage said bevelled edges of said crystal.

3. A watch casing according to claim 1, wherein said body member further comprises an outer flank and wherein edges of said crystal which do not engage said at least two first bearing surfaces, are flush with said outer flank.

4. A watch casing according to claim 1, wherein said upward projections are covered by a hard metal shield.

5. The watch casing of claim 1 wherein the securing means compresses the annular gasket between the crystal and said second bearing surface.

* * * * *